US006922537B2

(12) United States Patent
Iikawa et al.

(10) Patent No.: US 6,922,537 B2
(45) Date of Patent: Jul. 26, 2005

(54) IMAGE FORMING APPARATUS WITH HEAT MITIGATION DEVICES

(75) Inventors: Masaaki Iikawa, Iwatsuki (JP); Kazuaki Komatsubara, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/743,138

(22) Filed: Dec. 23, 2003

(65) Prior Publication Data

US 2004/0234291 A1 Nov. 25, 2004

(30) Foreign Application Priority Data

May 19, 2003 (JP) ..... 2003-139810

(51) Int. Cl.[7] ..... G03G 21/20
(52) U.S. Cl. ..... 399/92
(58) Field of Search ..... 399/92, 91

(56) References Cited

FOREIGN PATENT DOCUMENTS

| | | | |
|---|---|---|---|
| JP | 2-50169 | 2/1990 | |
| JP | 5-224476 | 9/1993 | |
| JP | 6-230617 | 8/1994 | |
| JP | 06230617 A * | 8/1994 | ..... G03G/15/00 |

* cited by examiner

*Primary Examiner*—Quana Grainger
(74) *Attorney, Agent, or Firm*—Morgan Lewis & Bockius LLP

(57) ABSTRACT

An image forming apparatus has an image supporting body that supports a toner image and an exposure part that exposes the image supporting body. The image forming apparatus also has a transfer part for transferring the toner image formed on the image supporting body onto a recording medium and a fixing device that fixes the toner image transferred onto the recording medium to the recording medium. Moreover a control part and a power supply part and a blowing unit are held by the image forming apparatus and the blowing unit generates an air flow. The control part, the power supply part, and the exposure part are disposed at an upstream side of the air flow generated by the blowing unit, and the fixing device is disposed at a downstream side.

15 Claims, 9 Drawing Sheets

IMAGE FORMING APPARATUS WITH HEAT MITIGATION DEVICES

BACKGROUND OF THE INVENTION

1. Field of the Invention

The present invention relates to an image forming apparatus of an electrophotographic system or the like.

2. Description of the Related Art

In an image forming apparatus of an electrophotographic system, a toner image is transferred to a sheet, and this toner image is fixed to the sheet. With respect to the fixation of the toner image, a heat pressure fixing device using heat and pressure is generally used. There is a fear that radiation heat or the like generated from this kind of fixing device has a bad influence on other structural elements.

Thus, it is conventionally well known to provide a blowing unit for exhausting the heat of the fixing device to the outside (see patent documents 1 to 3).

[Patent document 1] JP-A-2-50169

[Patent document 2] JP-A-5-224476

[Patent document 3] JP-A-6-230617

However, when an image forming apparatus is miniaturized, respective structural elements must be put together and arranged, and there is increased fear that the heat generated from the fixing device has a bad influence on other structural elements. Especially, when the heat enters an exposure part, the temperature of a component (for example, a plastic lens or a scanner motor) constituting the exposure part becomes high, and there is a problem that the refractivity is changed by the thermal expansion of the plastic lens, or the lifetime of bearings of the scanner motor becomes short. Besides, when a cooling unit is provided in the respective structural elements, the number of parts is increased, and this causes the cost to become high and may hinder the miniaturization of the image forming apparatus.

SUMMARY OF THE INVENTION

The present invention has been made in view of the above circumstances and provides an image forming apparatus in which even if it is miniaturized, heat from a fixing device is efficiently exhausted to the outside, and the influence of the heat on other structural elements including an exposure part can be reduced.

In order to solve the above problems, according to an aspect of the present invention, an image forming apparatus includes an image supporting body for supporting a toner image, an exposure part for exposing the image supporting body, a transfer part for transferring the toner image formed on the image supporting body onto a recording medium, a fixing device for fixing the toner image transferred onto the recording medium to the recording medium, a control part, a power supply part, and a blowing unit for generating an air flow, in which the control part, the power supply part, and the exposure part are disposed at an upstream side of the air flow generated by the blowing unit, and the fixing device is disposed at a downstream side. Accordingly, since the control part, the power supply part and the exposure part, which are apt to be influenced by heat, are disposed at the upstream side of the air flow generated by the blowing unit, it is possible to reduce the influence of radiation heat or the like, which is generated by the fixing device, upon the control part, the power supply part and the exposure part.

Preferably, the blowing unit includes an air inlet, an air outlet, and a blowing fan disposed between the air outlet and the air inlet, at least one of the control part, the power supply part and the exposure part is disposed at an upstream side of the blowing fan, and the fixing device is provided at a downstream side of the blowing fan. Accordingly, since the control part, the power supply part and the exposure part are provided between the air inlet and the blowing fan, they can receive the outer air in flowing from the air inlet, so that they are effectively cooled. Besides, since the fixing device is provided between the blowing fan and the air outlet, the radiation heat or the like generated by the fixing device is directly exhausted to the outside through the air outlet, so that it is possible to effectively reduce the influence of the radiant heat, which is generated by the fixing device, upon the control part, the power supply part and the exposure part.

Preferably, the blowing unit further includes an exhaust fan, and this exhaust fan is disposed between the fixing device and the air outlet. By this, the radiant heat or the like generated by the fixing device can be effectively exhausted, and the air flow generated by the blowing fan can be intensified, so that it is possible to reduce the influence of the radiant heat or the like, which is generated by the fixing device, upon other structural elements.

Preferably, there is provided an image forming apparatus main body which houses the image supporting body, the exposure part, the transfer part, the fixing device, the control part and the power supply part, and the blowing fan is disposed apart from the contour of the image forming apparatus main body. Accordingly, it is possible to reduce the leak of noise, which is generated by the blowing fan, out of the image forming apparatus main body.

Preferably, the control part, the power supply part, and the exposure part are disposed in parallel to the air flow generated by the blowing fan. By this, the control part, the power supply part and the exposure part can mutually reduce the influence of heat upon the other structural elements. Besides, it is preferable that at least one of the control part and the power supply part is provided above the exposure part. By this, it is possible to reduce the bad influence of heat, which is generated by at least one of the control part and the power supply part, upon the exposure part.

BRIEF DESCRIPTION OF THE DRAWINGS

Preferred embodiments of the present invention will be described in detail based on the following figures, wherein.

DETAILED DESCRIPTION OF THE INVENTION

Embodiments of the invention will be described with reference to the drawings.

Figure 1:
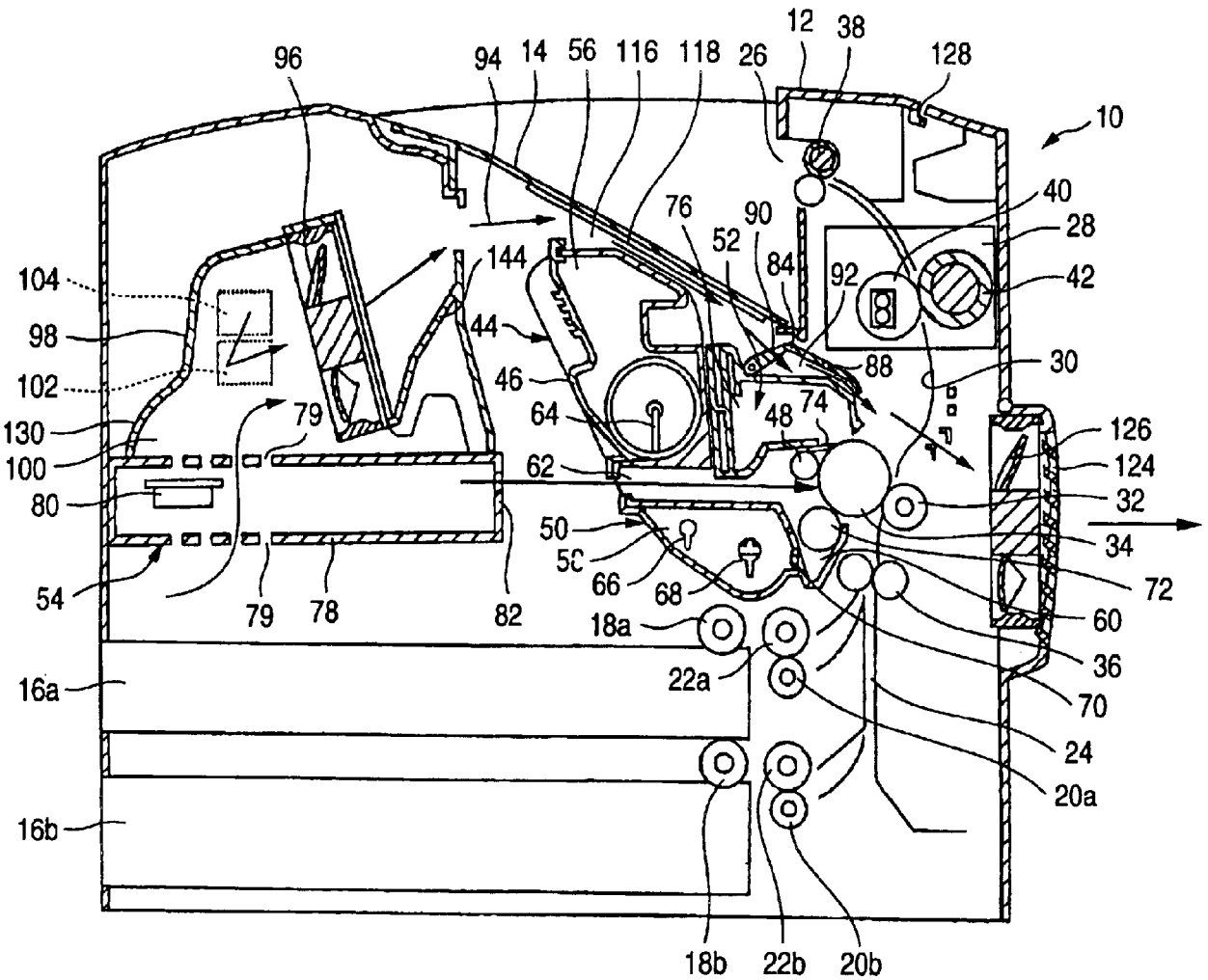
FIG. 1 is a sectional view showing an image forming apparatus of an embodiment of the invention.

FIG. 1 shows the outline of an image forming apparatus 10 according to an embodiment of the invention. The image forming apparatus 10 includes an image forming apparatus main body 12, an exhaust part 14 is provided at an upper part of the image forming apparatus main body 12, and for example, two stage sheet feeding cassettes 16*a* and 16*b* are disposed at a lower part of the image forming apparatus main body 12.

Pickup rolls 18*a* and 18*b* are disposed in the vicinities of the upper parts of innermost ends of the respective sheet feeding cassettes 16*a* and 16*b*, and retarder rolls 20*a* and 20*b* and feed rolls 22*a* and 22*b* are disposed in front of the pickup rolls 18*a* and 18*b*.

A transporting passage 24 is a sheet passage from the pickup roll 18*b* of the lower end sheet feeding cassette 16*b* to an exhaust port 26, and this transporting passage 24 includes a portion located in the vicinity of the back surface (right side of FIG. 1) of the image forming apparatus main body 12 and substantially vertically formed from the feed roll 22*b* of the lower end sheet feeding cassette 16*b* to an after-mentioned fixing device 28. An after-mentioned transfer device 32 and an image supporting body 34 are disposed through a sheet transporting guide 30 at the upstream side of this transporting passage 24 with respect to the fixing device 28, and a resist roll 36 is disposed at the upstream side of the transfer device 32 and the image supporting body 34. Incidentally, the sheet transporting guide 30 has many vent holes, and air can pass through them. Besides, an exhaust roll 38 is disposed in the vicinity of the exhaust port 26 of the transporting passage 24.

Accordingly, a sheet selectively sent out from one of the sheet feeding cassettes 16*a* and 16*b* by the pickup roll 18*a* or 18*b* is handled by the retarder roll 20*a* or 20*b* and the feed roll 22*a* or 22*b*, is guided to the transporting passage 24, is temporarily stopped by the resist roll 36, and passes through the transfer device 32 and the image supporting body 34 described later at a suitable timing so that a toner image is transferred, this transferred toner image is fixed by the fixing device 28, and the sheet is exhausted to the exhaust part 14 from the exhaust port 26 by the exhaust roll 38.

The exhaust part 14 is inclined so that a portion of the exhaust port is low, and gradually becomes high toward the front direction (left direction of FIG. 1). This exhaust part 14 is supported by the image forming apparatus main body 12 so that it can be freely rotated around a lower end. This exhaust part 14 is rotated upward and is opened, so that an after-mentioned process cartridge 44 can be detached and attached.

The fixing device 28 is constituted by, for example, a heat roll 40 and a pressure roll 42, the heat roll 40 and the pressure roll 42 are brought into pressure contact with each other to form a nip part, and the sheet passes through this nip part so that the toner image is fixed to the sheet.

The process cartridge 44 includes a process cartridge main body 46, and the image supporting body 34, a charging device 48, a developing device 50 and a cleaning device 52 are contained in the process cartridge main body 46 and are integrated. The image supporting body 34 is made of, for example, a photoreceptor, and a latent image is formed by an after-mentioned optical writing device 54. Besides, the transfer device 32 made of, for example, a transfer roll is disposed so as to be opposite to the image supporting body 34. The charging device 48 is formed of, for example, a charging roll, comes in contact with the image supporting body 34 and rotates, and uniformly charges the image supporting body 34.

The developing device 50 makes the latent image formed on the image supporting body 34 a visible image by toner, and includes a first toner storage chamber 56, a second toner storage chamber 58, and a developing chamber 60. The first toner storage chamber 56 and the second toner storage chamber 58 are disposed above and below an opening part 62, a first toner agitating and transporting member 64 is disposed in the first toner storage chamber 56, second to fourth toner agitating and transporting members 66, 68 and 70 are disposed in the second toner storage chamber 58, and toner is transported to the developing chamber 60. The opening part 62 is formed so that scanning light from the after-mentioned optical writing device 54 passes through, the first toner storage chamber 56 and the second toner storage chamber 58 communicate with each other through the opening part 62, and the toner of the first toner storage chamber 56 is transported to the second toner storage chamber 58. A developing roll 72 is disposed in the developing chamber 60, and this developing roll 72 causes the latent image of the image supporting body 34 to support the toner image.

A cleaning device 52 includes, for example, a cleaning blade 74 and a toner recovery chamber 76, and the toner scraped off by this cleaning blade 74 is recovered into the toner recovery chamber 76.

The optical writing device 54 is located in the image forming apparatus main body 12 and is disposed in the vicinity (vicinity of the left end of FIG. 1) of the front of the image forming apparatus main body 12 in parallel to the sheet feeding cassettes 16*a* and 16*b*. This optical writing device 54 includes an optical writing device main body 78, and plural vent holes 79 for allowing the passage of air are provided in the upper surface and the lower surface of the optical writing device main body 78, respectively. This optical writing device main body 78 contains therein a polygon unit 80 composed of a polygon mirror and a motor for rotating the polygon mirror, a semiconductor laser (not shown), and other optical parts (not shown) such as a plastic lens. Scanning light is emitted from an outgoing window 82 formed in the optical writing device main body 78 at the process cartridge side, and the scanning light is irradiated to the image supporting body 34 through the opening part 62 of the process cartridge 44.

Figure 2:
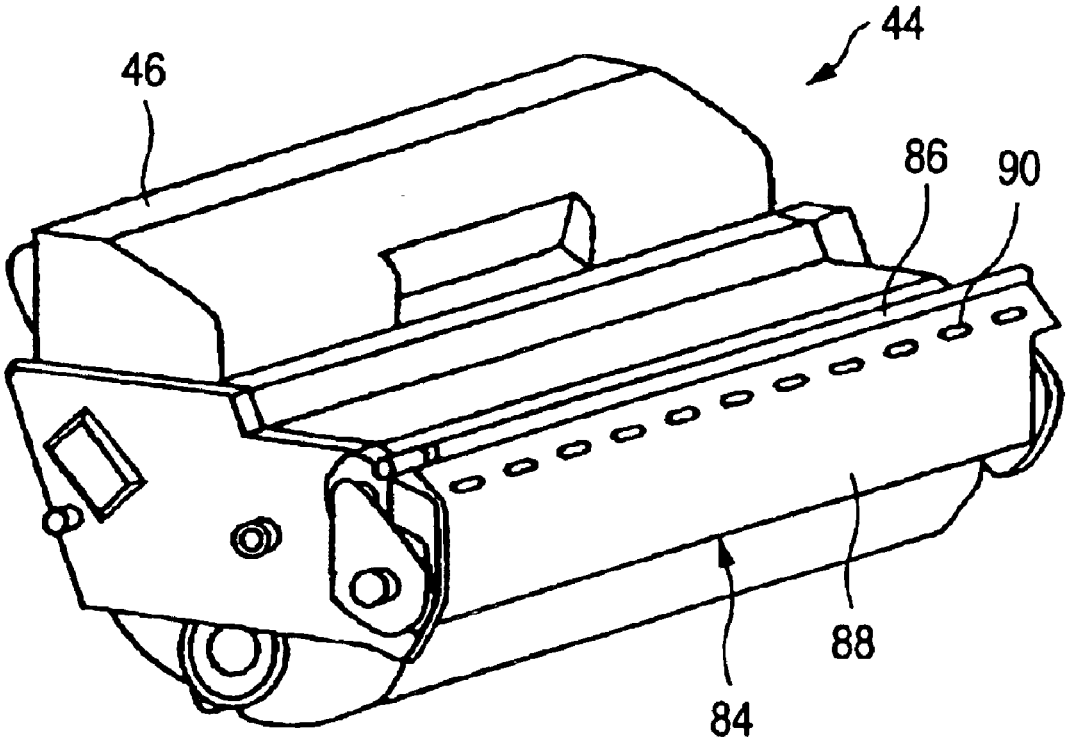
FIG. 2 is a perspective view showing a process cartridge used for the image forming apparatus of the embodiment of the invention.

Further, the process cartridge 44 includes a shutter 84 for opening and closing the side face of the image supporting body 34 at the transfer device 32 side. As shown in FIG. 2, this shutter 84 includes a support part 86 rotatably and movably supported to the process cartridge main body 46, and a shield part 88 extending from this support part 86. This shutter 84 is guided by a guide (not shown) provided in the image forming apparatus main body 12 so that it is opened and closed in synchronization with the attachment and detachment of the process cartridge 44. That is, before the process cartridge 44 is mounted, the shutter 84 closes the side portion of the image supporting body 34 by a not-shown elastic body to protect the image supporting body 34, and after the process cartridge 44 is mounted, as shown in FIG. 1, it is moved against the not-shown elastic body to a retract position where the side portion of the image supporting body 34 is opened. In this retract position, the shield part 88 faces the heat roll 40 of the fixing device 28, shuts off the radiant heat or the like from the heat roll 40, and prevents the process cartridge 44 from being heated.

In the shutter 84, many vent holes 90 are formed in parallel to the support part 86 and in the vicinity of the support part of the shield part 88. In the case where the shutter 84 is in the retract position, a first gap 92 is formed between the shutter 84 and the process cartridge main body 46. The vent holes 90 communicates with the first gap 92, the first gap 92 constitutes a part of an after-mentioned air passage 94, and an air flow is generated in the first gap 92 by the air introduced through the vent holes 90 to cool the process cartridge 44. Further, the air having passed through the first gap 92 cools the air around the fixing device 28, and passes through the sheet transporting guide 30.

A blowing fan 96 is located in the image forming apparatus main body 12, is disposed above the optical writing device 54, and feeds the air from the front side of the image forming apparatus main body 12 to the back side (from the left to the right of FIG. 1). A first duct 98 is provided at the upstream side of the blowing fan 96. The first duct 98 covers the upper part of the optical writing device 54 and the upstream side of the blowing fan 96, and an inlet part 100 for receiving the air is provided at the left side (back side of the paper plane of FIG. 1) of the image forming apparatus main body 12. Incidentally, the blowing fan 96 is disposed to be separated from the contour of the image forming apparatus main body 12, so that the leakage of noise, which is generated by the blowing fan 96, into the outside of the image forming apparatus main body 12 is reduced.

Figure 3:
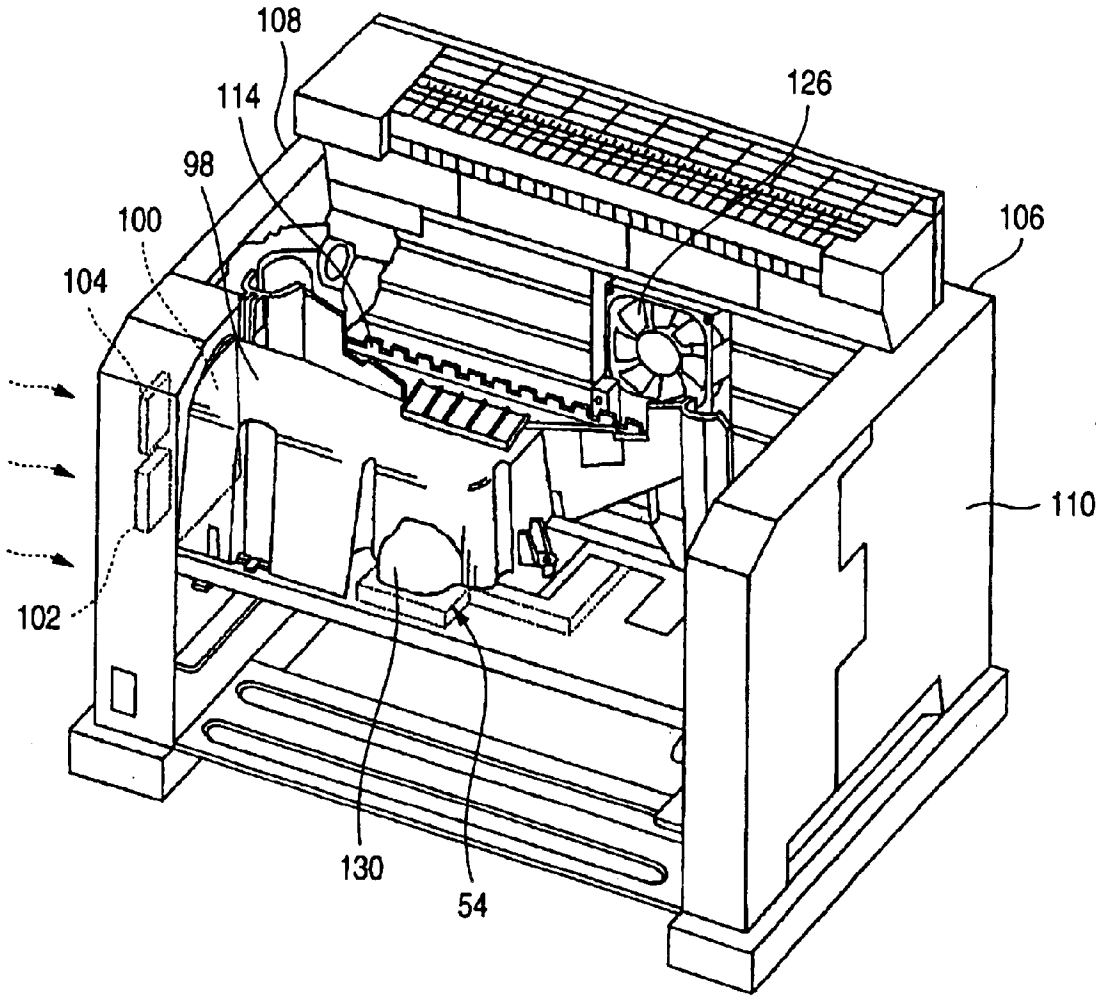
FIG. 3 is a perspective view showing the arrangement of an optical writing device, a power supply device and a control device of the image forming apparatus of the embodiment of the invention.

FIG. 3 is a perspective view showing the arrangement of the optical writing device 54, the power supply device 102, and the control device 104. The image forming apparatus main body 12 includes, as an enclosure, a back surface part 106 (right side of FIG. 1), a left surface part 108 (back side of the paper plane of FIG. 1), and a right surface part 110. The power supply device 102 and the control device 104 are provided in parallel in the left surface part 108. The power supply device 102 and the control device 104 are positioned above the optical writing device 54 and is opposed to the inlet part 100. The power supply device 102 receives external electric power and supplies the electric power to the respective parts constituting the image forming apparatus 10. The control device 104 controls the respective parts constituting the image forming apparatus 10.

A second duct 114 is provided at the downstream side of the blowing fan 96. The second duct 114 constitutes a part of the after-mentioned air passage 94. Further, at the downstream side of the second duct 114, a second gap 116 is formed at the upper part of the foregoing first toner storage chamber 56 and between the process cartridge main body 46 and the exhaust part 14. In the exhaust part 14, many air guide ribs 118 protruding toward the second gap 116 are formed in parallel to the direction of the air flow.

Figure 4:
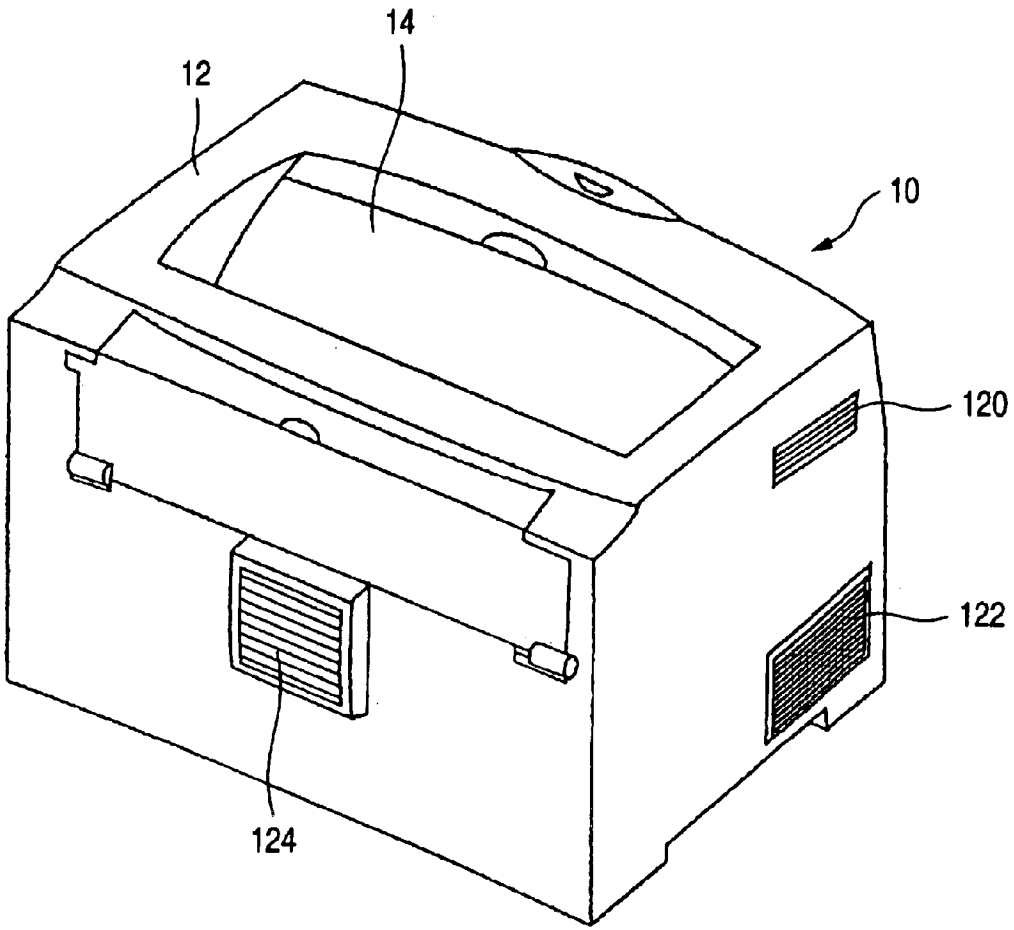
FIG. 4 is a perspective view showing the image forming apparatus of the embodiment of the invention.

In the image forming apparatus 10, as shown in FIG. 4, a first air inlet 120 is provided at the upper part of the left side, a second air inlet 122 is provided at the lower part of the left side, and an air exhaust outlet 124 is provided at the back surface (right side of FIG. 1). The first air inlet 120 is disposed to be substantially opposite to the power supply device 102 and the control device 104. Besides, the first air inlet 120 takes the outside air (outer air) into the image forming apparatus 10 by the rotation of the blowing fan 96. The second air inlet 122 is disposed below the optical writing device 54. Besides, the second air inlet 122 takes the outer air into the lower part of the optical writing device 54 by the rotation of the blowing fan 96. The air outlet 124 is disposed substantially at the center of the back surface of the image forming apparatus 10. Further, an exhaust fan 126 is located in the image forming apparatus main body 12, is provided to be opposite to the air outlet 124, and exhausts the air in the image forming apparatus main body 12 through the air outlet 124. Besides, a vent hole 128 for allowing the passage of air between the inside and the outside of the image forming apparatus main body 12 is provided above the fixing device 28 and at the upper surface (upper side of FIG. 1) of the image forming apparatus main body 12.

Incidentally, as shown in FIG. 1, it is not always necessary to cause the front of the blowing fan 96 to be opposite to the process cartridge 44, and it may be disposed at an arbitrary angle in accordance with the intensity of the air flow and cooling places. For example, the blowing fan 96 may be disposed to be opposite to the foregoing power supply device 102 and the control device 104.

Next, the details of the air passage 94 will be described.

The air passage 94 is an air flow passage from the foregoing first air inlet 120 and the second air inlet 122 to the air outlet 124. Besides, it is preferable that the blowing unit recited in the claims is constituted by the first air inlet 120, the second air inlet 122, the blowing fan 96, the exhaust fan 1-26, the air outlet 124 and the like, and further, the foregoing vent hole 128 may be provided.

Figure 5:
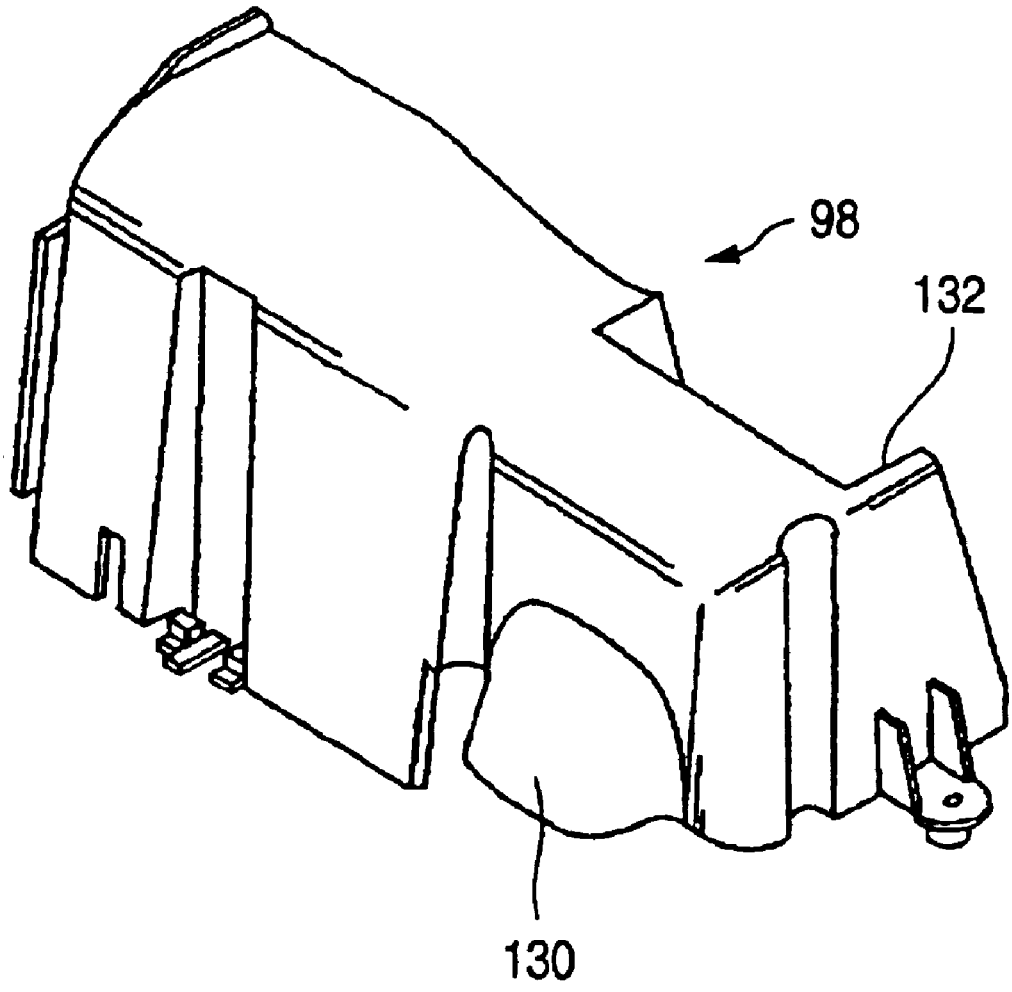
FIG. 5 is a perspective view showing a first duct used for the image forming apparatus of the embodiment of the invention and viewed from the front side.
Figure 6:
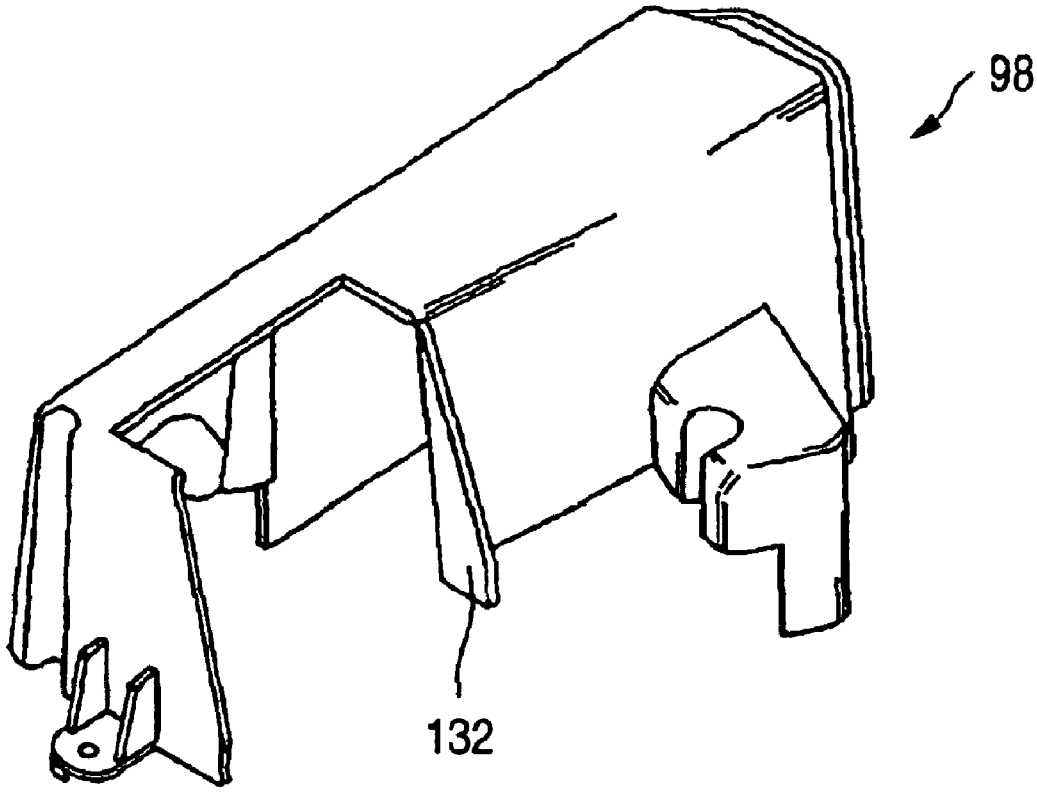
FIG. 6 is a perspective view showing the first duct used for the image forming apparatus of the embodiment of the invention and viewed from the back side.
Figure 8:
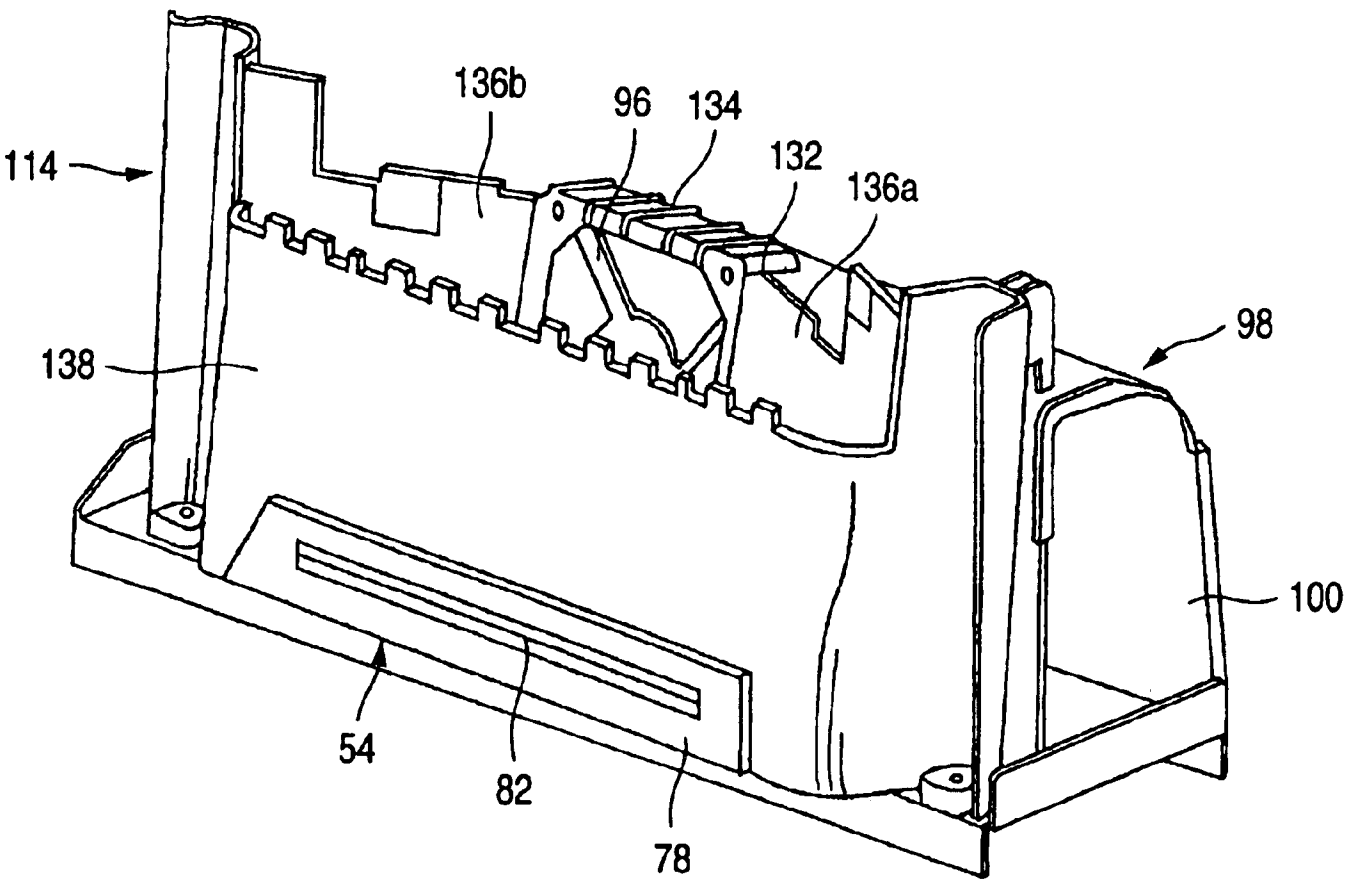
FIG. 8 is a perspective view showing a state where the optical writing device, the first duct, and the second duct used for the image forming apparatus of the embodiment of the invention are assembled and viewed from the back side.

The first air inlet 120 is connected to the inlet part 100 through the power supply device 102 and the control device 104. That is, when the blowing fan 96 is rotated and the outer air is taken in through the first air inlet 120, the power supply device 102 and the control device 104 are respectively cooled by the air. The second air inlet 122 is located at the left side of the image forming apparatus 10, is provided below the optical writing device 54, and is connected to the lower part of the first duct 98 through the plural vent holes 79 provided in the upper surface and the lower surface of the optical writing device main body 78. Besides, this first duct 98 extends from the inlet part 100 to substantially the center of the optical writing device 54, and as shown in FIGS. 5, 6 and 8, a projection 130 is formed at the front side (left side of FIG. 1) of the extending portion. This projection 130 is made opposite to the polygon unit 80 of the optical writing device 54. That is, the outer air taken from the second air inlet 122 into the lower part of the optical writing device 54 cools the polygon unit 80 and the like of the optical writing device 54, and is received by the projection 130 into the first duct 98. As stated above, the first duct 98 is connected to the first air inlet 120 through the power supply device 102 and the control device 104, and is connected to the second air inlet 122 through the optical writing device 54. Incidentally, the first air inlet 120 and the second air inlet 122 may be an integrally formed air inlet.

Besides, a blowing fan receiving part 132 is formed at the back side (right side of FIG. 1) of the first duct 98, and the blowing fan 96 is inserted and disposed in this blowing fan receiving part 132.

Figure 7:
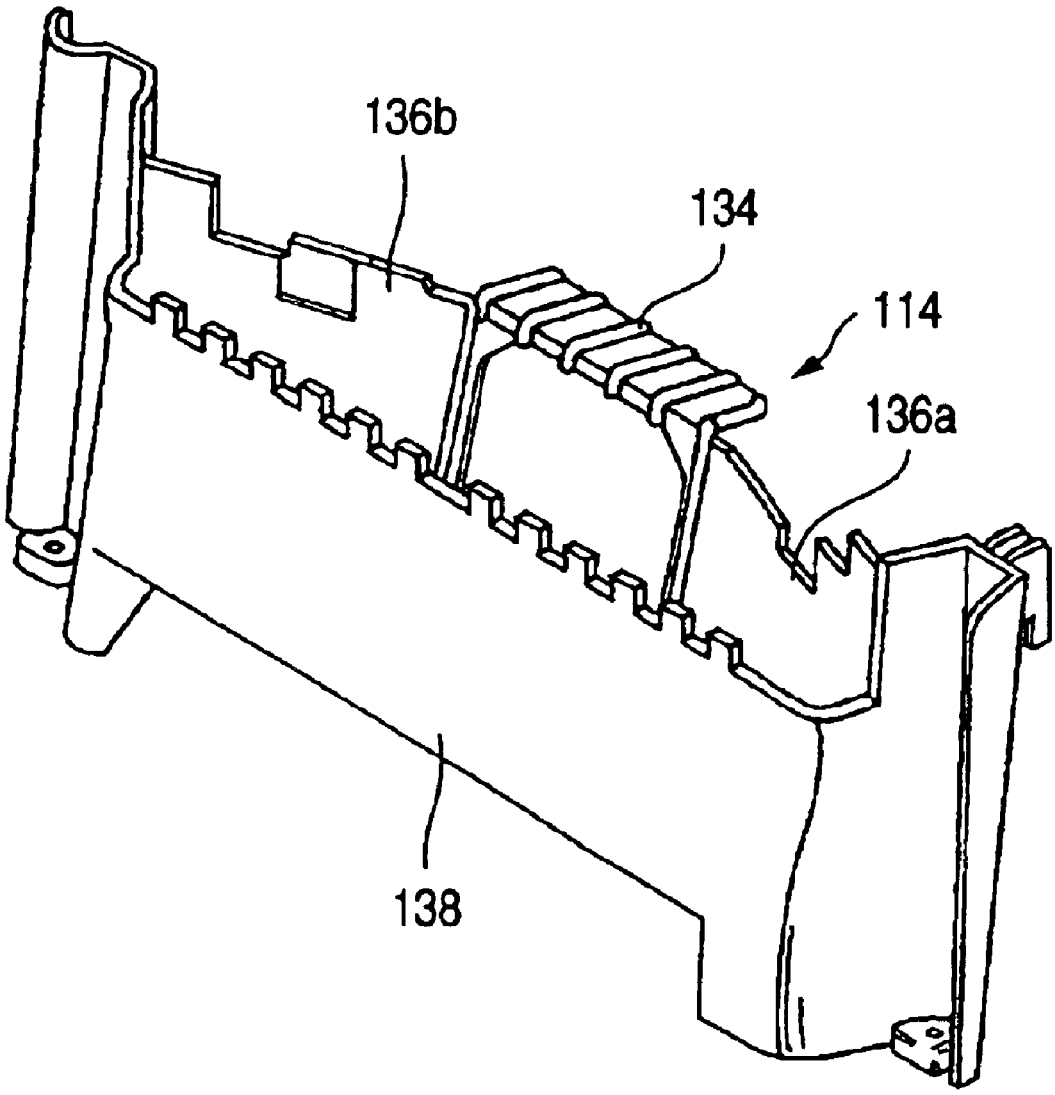
FIG. 7 is a perspective view showing a second duct used for the image forming apparatus of the embodiment of the invention and viewed from the back side.

The second duct 114 is connected to the first duct 98 at the blowing fan receiving part 132 of the first duct 98, and is, together with the first duct 98, attached to the upper part of the optical writing device 54. As shown in FIG. 7, in this second duct 114, a blowing fan attachment part 134 is provided substantially at the center front side of the second duct 114, and the blowing fan 96 is attached to the blowing fan attachment part 134. Besides, the second duct 114 includes first air guide surfaces 136*a* and 136*b* extending from the blowing fan attachment part 134 to both sides. Further, a second air guide surface 138 is provided to be opposite to the first air guide surfaces 136*a* and 136*b*. Accordingly, the air flow from the blowing fan 96 is guided by the first air guide surfaces 136*a* and 136*b* and the second air guide surface 138 to expand to both sides, passes through the upper part of the second air guide surface 138, and is sent to the process cartridge 44 side.

As described above, the second gap 116 is formed above the first toner storage chamber 56 and between the process cartridge main body 46 and the exhaust part 14. Besides, in the exhaust part 14, the many air guide ribs 118 projecting toward the second gap 116 are formed in parallel to the direction of the air flow. The air is made to flow toward the sheet transporting guide 30 through the second gap 116 and the foregoing first gap 92.

In the sheet transporting guide 30, as described before, the many vent holes are formed, and the air can smoothly pass through. The air outlet 124 is formed at the outside of the exhaust fan 126, and the air is exhausted through this air outlet 124.

Next, the function of an air cooling system by the blowing fan 96 and the exhaust fan 126 will be described. When the blowing fan 96 and the exhaust fan 126 are rotated, the outer air is sucked from the first air inlet 120 and the second air inlet 122 formed in the image forming apparatus 10. The outer air sucked from the first air inlet 120 enters the first duct 98 through the power supply device 102 and the control device 104. At this time, heat of the power supply device 102 and the control device 104 is lost by the sucked outer air, and the power supply device 102 and the control device 104 are respectively cooled. The air having cooled the power supply device 102 and the control device 104 is guided to the blowing fan 96 by the first duct 98. The outer air sucked from the second air inlet 122 enters the first duct 98 through the optical writing device 54. At this time, the heat of the optical writing device 54 is lost by the sucked outer air, and the optical writing device 54 is cooled. The air having cooled the optical writing device 54 is guided to the blowing fan 96 by the first duct 98.

The air guided to the blowing fan 96 is sent to the second duct 114 by the blowing fan 96. In this second duct 114, the air is expanded to both sides by the first air guide surfaces 136*a* and 136*b* and the second air guide surface 138, passes through the upper part of the second duct 114, and flows toward the process cartridge 44. Since the second gap 116 is formed between the process cartridge 44 and the exhaust part 14, the air passes through this second gap 116. Further, since the vent holes 90 are formed in the shutter 84, and the first gap 92 is formed between the process cartridge main body 46 of the process cartridge 44 and the shutter 84, the air passes through the first gap 92. Although radiant heat or the like from the fixing device 28 is shut off by the shield part 88 of the shutter 84 to a certain degree, heat of the process cartridge 44 is further lost by the air flow passing through the first gap 92, and the process cartridge 44 is cooled. Besides, the temperature of the fixing device 28 is higher than that of the other parts constituting the image forming apparatus 10, the air flow having passed through the process cartridge 44 and the like cools the heated air around the fixing device 28, and is sent to the sheet transporting guide 30 side. The air sent to the sheet transporting guide 30 side passes through the vent holes formed in the sheet transporting guide 30, and is exhausted to the outside of the image forming apparatus 10 through the exhaust fan 126 and the air outlet 124.

Figure 9:
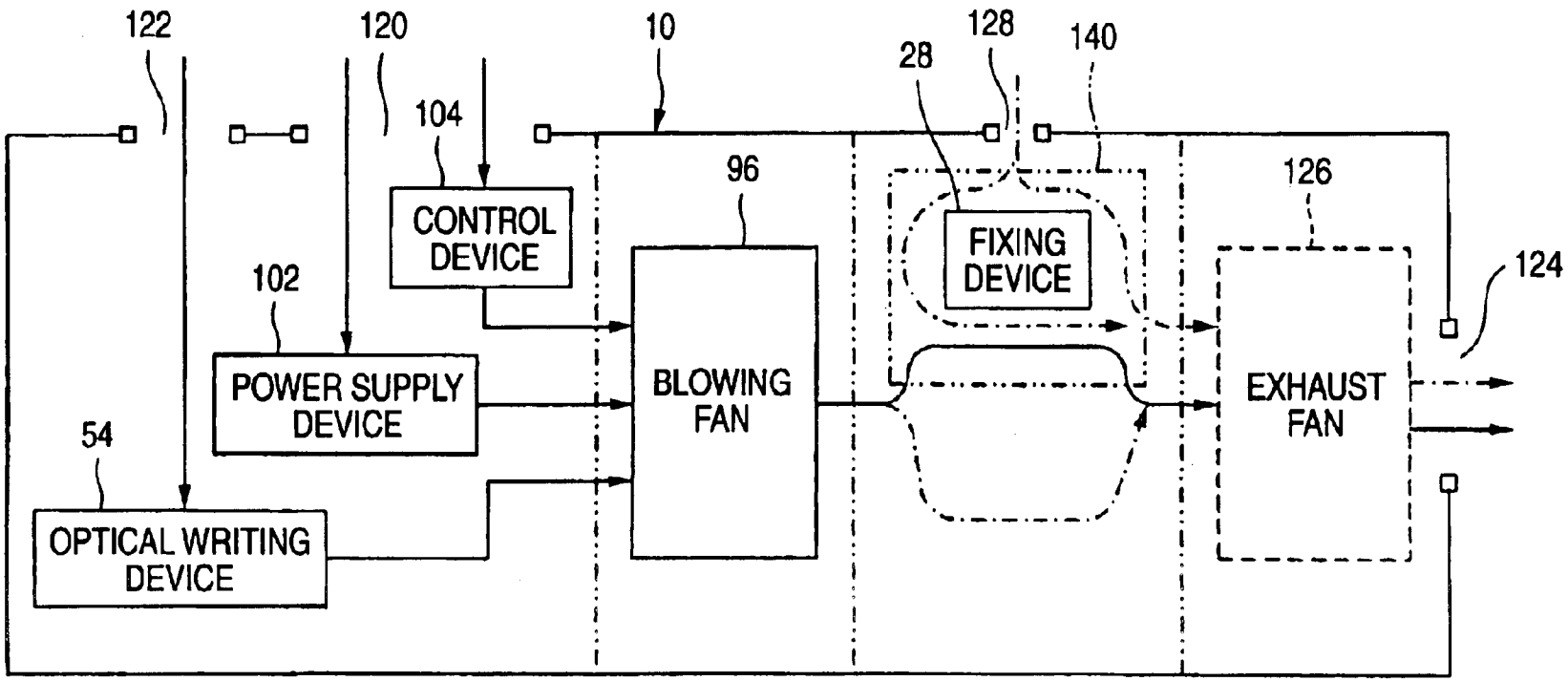
FIG. 9 is view schematically exemplifying the arrangement of the power supply device, the control device, the optical writing device, and a fixing device with respect to an air flow by a blowing fan of the image forming apparatus of the embodiment of the invention.

Next, a description will be given to the arrangement of the power supply device 102, the control device 104, the optical writing device 54 and the fixing device 28 with respect to the air flow by the blowing fan 96. FIG. 9 schematically shows the arrangement of the power supply device 102, the control device 104, the optical writing device 54 and the fixing device 28 with respect to the air flow by the blowing fan 96 of the image forming apparatus 10. The power supply device 102 and the control device 104 are provided between, for example, the first air inlet 120 and the blowing fan 96, and the optical writing device 54 is provided between, for example, the second air inlet 122 and the blowing fan 96. The fixing device 28 is provided between, for example, the blowing fan 96 and the air outlet 124. Thus, the power supply device 102, the control device 104 and the optical writing device 54 are respectively cooled by the outer air. Then, the air having cooled these is guided to the blowing fan 96. That is, the power supply device 102, the control device 104 and the optical writing device 54 can be cooled in parallel by the outer air, and the influence of the air heated by the other devices is mutually reduced.

The blowing fan 96 receives the air having cooled the power supply device 102, the control device 104 and the optical writing device 54, and sends the air, as an air flow, to a peripheral space 140 positioned around (mainly at the lower part) the fixing device 28. By this air flow, the blowing fan 96 cools the air of the peripheral space 140 and the like, and sends it to the air outlet 124. Besides, the exhaust fan 126 is provided between the fixing device 28 and the air outlet 124, so that the air flow is increased, and the power supply device 102, the control device 104, the optical writing device 54, the air of the peripheral space 140 and the like are efficiently cooled. Besides, although the outer air guided to the peripheral space 140 through the vent hole 128 is heated by the fixing device 28, it is exhausted by the blowing fan 126 and the like through the air outlet 124.

Thus, it is possible to prevent the heat generated by the fixing device 28 from having an influence on the control device 104, the power supply device 102, and the optical writing device 54 which are susceptible to heat. Besides, since the power supply device 102 and the control device 104 are disposed above the optical writing device 54, it is possible to reduce the degree that the heat generated by the power supply device 102 and the control device 104 ascends and goes around the optical writing device 54.

Incidentally, in the foregoing embodiment, although the blowing fan 96 is provided between the fixing device 28 and the power supply device 102, the control device 104, and the optical writing device 54, the invention is not limited to this, and as long as the fixing device 28 is disposed at the downstream side of the power supply device 102, the control device 104 and the optical writing device 54, the blowing fan may be provided at another place. Besides, the blowing unit may include three or more fans.

As described above, according to the invention, the power supply device, the control device and the optical writing device are provided at the upstream side of the air flow, and the fixing device is provided at the downstream side, so that even if the image forming apparatus is miniaturized, the heat from the fixing device is efficiently exhausted to the outside, and the influence of the heat upon the other structural elements including the exposure part can be reduced.

The entire disclosure of Japanese Patent Application No. 2003-139810 filed on May 19, 2003 including specification, claims, drawings and abstract is incorporated herein by reference in its entirety.

What is claimed is:

1. An image forming apparatus, comprising:

an image supporting body that supports a toner image;

an exposure part that exposes the image supporting body;

a transfer part that transfers the toner image formed on the image supporting body onto a recording medium;

a fixing device that fixes the toner image transferred onto the recording medium to the recording medium;

a control part;

a power supply part; and a blowing unit that generates an air flow, wherein the control part, the power supply part, and the exposure part are disposed at an upstream side of the air flow generated by the blowing unit, and the fixing device is disposed at a downstream side.

2. An image forming apparatus according to claim 1, wherein the blowing unit includes an air inlet, an air outlet, and a blowing fan disposed between the air outlet and the air inlet, at least one of the control part, the power supply part and the exposure part is disposed at an upstream side of the blowing fan, and the fixing device is provided at a downstream side of the blowing fan.

3. An image forming apparatus according to claim 2, wherein the blowing unit further includes an exhaust fan, and the exhaust fan is disposed between the fixing device and the air outlet.

4. An image forming apparatus according to claim 2, further comprising an image forming apparatus main body that houses the image supporting body, the exposure part, the transfer part, the fixing device, the control part and the power supply part, wherein the blowing fan is disposed apart from a contour of the image forming apparatus main body.

5. An image forming apparatus according to claim 1, wherein the control part, the power supply part, and the exposure part are disposed in parallel with respect to the air flow generated by the blowing unit.

6. An image forming apparatus according to claim 1, wherein at least one of the control part and the power supply part is provided above the exposure part.

7. An image forming apparatus, comprising:

a first heat source that generates heat when an image is formed;

a blowing unit that sends air heated by the first heat source as an air flow and the blowing unit is disposed inside the image forming apparatus and at a downstream side of the first heat source;

an exhaust part that exhausts the air flow sent by the blowing unit to an outside of the image forming apparatus;

an air inlet that takes in air from the outside of the image forming apparatus and is disposed on an opposite side of the blowing unit with respect to the first heat source; and an exposure part that irradiates light and an image supporting body that forms a latent image by the light irradiated by the exposure part, wherein the first heat source is the exposure part.

8. An image forming apparatus according to claim 7, wherein the first heat source is a power supply that supplies electric power to the image forming apparatus.

9. An image forming apparatus according to claim 7, wherein the first heat source is a control part that controls the image forming apparatus.

10. An image forming apparatus according to claim 7, wherein the exposure part includes an enclosure and a semiconductor laser that generates light, the enclosure has plural opening parts of the enclosure, and the air inlet is disposed in a vicinity of the opening part.

11. An image forming apparatus, comprising:

a first heat source that generates heat when an image is formed;

a blowing unit that sends air heated by the first heat source as an air flow and the blowing unit is disposed inside the image forming apparatus and at a downstream side of the first heat source;

an exhaust part that exhausts the air flow sent by the blowing unit to an outside of the image forming apparatus; and a process cartridge that is disposed between the blowing unit and the exhaust part and performs an electrophotographic process to form the image, and an air passage that is constructed between the process cartridge and a housing of the image forming apparatus, and allows passage of the air flow.

12. An image forming apparatus according to claim 11, further comprising a sheet transporting passage between the exhaust part and the process cartridge, wherein the sheet transporting passage is provided with vent holes that allow passage of the air flow.

13. An image forming apparatus according to claim 12, wherein an opposite outer surface of the housing of the image forming apparatus constituting the air passage is an eject part where a sheet transported from the sheet transporting passage is ejected.

14. An image forming apparatus according to claim 11, further comprising a fixing device in a vicinity of the process cartridge, wherein the process cartridge includes a shutter that is moved, when the process cartridge is mounted in the image forming apparatus, to a position where radiant heat of the fixing device is shut off.

15. A cooling method for an image forming apparatus in which a power supply device and a control device are provided between a first air inlet and a blowing fan, an optical writing device is provided between a second air inlet and the blowing fan, and a fixing device is provided between the blowing fan and an air outlet, comprising receiving air having cooled the power supply device, the control device and the optical writing device into the blowing fan, blowing air as an air flow to a peripheral space positioned around the fixing device, cooling air of the peripheral space by the air flow blown by the blowing fan, and exhausting the air through the air outlet.

* * * * *